US011624188B2

(12) United States Patent
Stearns et al.

(10) Patent No.: US 11,624,188 B2
(45) Date of Patent: Apr. 11, 2023

(54) HYBRID SNOW AND ICE RETENTION SYSTEM

(71) Applicant: Vermont Slate & Copper Services, Inc., Morrisville, VT (US)

(72) Inventors: Brian Stearns, Tuscon, AZ (US); Kris Michaud, Morrisville, VT (US)

(73) Assignee: Vermont Slate & Copper Services, Inc., Morrisville, VT (US)

( * ) Notice: Subject to any disclaimer, the term of this patent is extended or adjusted under 35 U.S.C. 154(b) by 65 days.

(21) Appl. No.: 17/167,026

(22) Filed: Feb. 3, 2021

(65) Prior Publication Data

US 2021/0310205 A1 Oct. 7, 2021

Related U.S. Application Data

(60) Provisional application No. 62/969,584, filed on Feb. 3, 2020.

(51) Int. Cl.

| | |
|---|---|
| ***E04D 13/00*** | (2006.01) |
| ***E04B 7/18*** | (2006.01) |
| ***E01F 7/04*** | (2006.01) |
| ***E04D 13/10*** | (2006.01) |

(52) U.S. Cl.
CPC ..... *E04B 7/18* (2013.01); *E01F 7/04* (2013.01); *E04D 13/10* (2013.01)

(58) Field of Classification Search
CPC ..... E04F 7/04; E04B 7/18; E04D 13/10
USPC ..... 52/24, 25, 26
See application file for complete search history.

(56) References Cited

U.S. PATENT DOCUMENTS

| | | | | | |
|---|---|---|---|---|---|
| 97,316 | A | * | 11/1869 | Rogers | E04D 13/10 52/24 |
| 106,580 | A | * | 8/1870 | Hathorn | E04D 13/10 52/25 |
| 185,137 | A | * | 12/1876 | Rogers | A47G 7/041 52/24 |
| 302,429 | A | * | 7/1884 | Rogers | E04D 13/10 52/24 |
| 473,512 | A | * | 4/1892 | Laird | E04D 13/10 52/25 |
| 756,884 | A | * | 4/1904 | Parry | E04D 13/10 52/25 |
| 939,516 | A | * | 11/1909 | Laird | E04D 13/10 52/25 |

(Continued)

*Primary Examiner* — Brian E Glessner
*Assistant Examiner* — James J Buckle, Jr.
(74) *Attorney, Agent, or Firm* — KW Law, LLP

(57) ABSTRACT

Implementations described and claimed herein provide for modular snow and ice retention and mounting systems. In various embodiments, a bracket may comprise a mounting strap, a hybrid pad, a bracket assembly and a rod. The hybrid pad may comprise a face portion and a support portion. The face portion and the support portion may be operatively coupled together. The hybrid pad may be operatively coupled to the mounting strap. The face portion may comprise a stiffening rib. The stiffening rib may be defined in a front surface of the face portion. The stiffening rib may define a first load plane. The face portion may also define a first rod notch. The first rod notch may be defined on a first side of the face portion. The face portion may also define a second rod notch. The rod may be mountable to the hybrid pad.

20 Claims, 15 Drawing Sheets

(56) References Cited

U.S. PATENT DOCUMENTS

| | | | | | |
|---|---|---|---|---|---|
| 1,095,822 | A * | 5/1914 | Danzer | E04D 13/10 | 52/25 |
| 1,222,953 | A * | 4/1917 | Histand | E04D 13/10 | 52/24 |
| 2,079,768 | A * | 5/1937 | Levow | E04D 13/10 | 52/25 |
| 5,613,328 | A * | 3/1997 | Alley | E04D 13/10 | 52/24 |
| 5,669,184 | A * | 9/1997 | Anderson | E04D 13/10 | 52/24 |
| 5,715,640 | A * | 2/1998 | Haddock | E04D 13/103 | 52/537 |
| 6,070,368 | A * | 6/2000 | Anderson | E04D 13/10 | 52/24 |
| 6,223,477 | B1 * | 5/2001 | Alley | E04D 13/10 | 52/24 |
| 6,256,934 | B1 * | 7/2001 | Alley | E04D 13/10 | 52/24 |
| 6,298,608 | B1 * | 10/2001 | Alley | E04D 13/10 | 248/217.4 |
| 6,357,184 | B1 * | 3/2002 | Alley | E04D 13/10 | 52/843 |
| 6,453,623 | B1 * | 9/2002 | Nelson | E04D 13/10 | 52/24 |
| 6,834,466 | B2 * | 12/2004 | Trevorrow | E04D 13/10 | 248/512 |
| 7,140,152 | B2 * | 11/2006 | Thaler | E04D 13/10 | 52/25 |
| 2001/0045064 | A1 * | 11/2001 | Alley | E04D 13/10 | 52/24 |
| 2009/0205262 | A1 * | 8/2009 | Andrew | E04D 13/10 | 52/26 |

* cited by examiner

HYBRID SNOW AND ICE RETENTION SYSTEM

CROSS REFERENCE TO RELATED APPLICATIONS

The present application claims the benefit of and priority to U.S. Patent Application No. 62/969,584 entitled "HYBRID SNOW AND ICE RETENTION SYSTEM" and filed on Feb. 3, 2020, which is incorporated herein by reference in its entirety for any purpose.

FIELD

The present disclosure relates to snow and ice retention devices and, more specifically, the snow and ice retention devices that are capable of being modularly installed to accommodate varying loads and snow retention requirements.

BACKGROUND

Snow and ice retention are typically installed on surfaces that accumulate snow and ice and that create a risk of snow and/or ice avalanche. Depending on the location of the structure associated with the accumulating surface, there may be a need to retain snow and/or ice and prevent or minimize avalanches

SUMMARY

Implementations described and claimed herein provide for modular snow and ice retention and mounting systems. In various embodiments, a bracket may comprise a mounting strap, a hybrid pad, a bracket assembly and a rod. The hybrid pad may comprise a face portion and a support portion. The face portion and the support portion may be operatively coupled together. The hybrid pad may be operatively coupled to the mounting strap. The face portion may comprise a stiffening rib. The stiffening rib may be defined in a front surface of the face portion. The stiffening rib may define a first load plane. The face portion may also define a first rod notch. The first rod notch may be defined on a first side of the face portion. The face portion may also define a second rod notch. The second rod notch may be defined on a second side of the face portion. The stiffening rib may be defined between the first side and the second side. The first rod notch and the second rod notch may define a second load plane. The bracket assembly may comprise a bracket and a fastener. The bracket assembly operatively coupled to the hybrid pad. The rod may be mountable to the hybrid pad. The rod may be configured to contact the face portion at the stiffening rib in the first load plane. The rod may also be configured to contact the first rod notch and the second rod notch in the second load plane. The rod may be secured to the hybrid pad with the bracket assembly.

In various embodiments, the second load plane may be coplanar with the first load plane. The hybrid pad may be monolithic. The hybrid pad may be an assembly. The mounting strap may have a variable length. The mounting strap may have a plurality of cut notches.

In various embodiments, the bracket described herein may further comprising an ice screen. The ice screen may have a variable screen density. The ice screen may be operatively coupled to the rod. The rod may be a plurality of rods. Each of the rods of the plurality of rods may engage the hybrid pad in a plane that may be coplanar with the first load plane and the second load plane.

In various embodiments, a snow guard attachment bracket may comprise a mounting strap, a hybrid pad, a face portion, a rod, and a bracket. The hybrid pad may comprise a face portion and a support portion. The face portion and the support portion may be operatively coupled together. The hybrid pad operatively coupled to the mounting strap. The hybrid pad may comprise a plurality of mounting points. The face portion may comprise a stiffening rib. The stiffening rib defined in a front surface of the face portion. The face portion may also comprise a plurality of mounting holes. The plurality of holes may be defined through a stiffening. The plurality of holes may define a first mounting point of the plurality of mounting points. The first mounting point may be defined on a first face side of the face portion. The plurality of mounting holes may define a second mounting point on a second face side of the face portion. The support portion may comprise additional mounting points. For example, the support portion may comprise a third mounting point of the plurality of mounting points. The third mounting point may be defined on a first support side of the support portion. The support portion may also comprise a fourth mounting point of the plurality of mounting points. The fourth mounting point may be defined on a second support side of the support portion. The rod may be mountable to one of the plurality of mounting point. The bracket may be configured to engage one of the plurality of mounting points and retain the rod on the hybrid pad.

In various embodiments, the snow guard attachment bracket may further comprise an ice screen. The ice screen may have a variable screen density. The ice screen may be operatively coupled to at least one of the rod and the hybrid pad. The snow guard attachment bracket may further comprise a second rod.

In various embodiments, the stiffening rib may define a first load plane. The face portion may define a first rod notch. The first rod notch may be defined on a first edge of the first face side. The face portion may also define a second rod notch. The second notch may be defined on a second edge of the first face side. The stiffening rib may be defined between the first edge and the second edge. The first rod notch and the second rod notch may define a second load plane. The first load plane and the second load plane may be coplanar. The rod may be configured to engage and be supported by the stiffening rib, the first rod notch, and the second rod notch.

The rod may be installable in the first load plane and the second load plane. The rod may be installable in at least on the first load plane and the second load plane.

In various embodiments, a snow guard may comprise a hybrid pad, a rod and a bracket. The hybrid pad may comprise a face portion and a support portion. The face portion and the support portion may be operatively coupled together. The face portion may comprise a stiffening rib. The stiffening rib may be defined in the face portion. The face portion may also include a plurality of mounting holes. The mounting holes may be defined through the stiffening rib. The mounting holes may define a first mounting point. The face portion may comprise a first notch. The first notch may be defined along a first edge of the face portion. The face portion may also comprise a second notch. The second notch may be defined along a second edge of the face portion. The first notch and the second notch may define a notch plane. The rod may be mountable to the face portion. The rod may be mountable in the first notch and the second notch. In this regard, the rod may be supported by the hybrid pad in the notch plane. The bracket may be configured to engage the face portion. The bracket may also be configured to retain the rod on the hybrid pad.

In various embodiments, the stiffening rib may define a rib plane. The rib plane that may be coplanar with the notch plane. The rod may be configured to engage and be supported by the rib plane in response to being installed on the hybrid pad.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements

DETAILED DESCRIPTION

The detailed description of exemplary embodiments herein refers to the accompanying drawings, which show exemplary embodiments by way of illustration. While these exemplary embodiments are described in sufficient detail to enable those skilled in the art to practice the inventions, other embodiments may be realized, and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

The present disclosure relates to snow and ice retention devices. These devices are commonly referred to as snow guards. These devices are installable on roofs and other suitable building surfaces. The devices are configured to retain snow and/or ice on the building surface. In this regard, the device is configured to hold snow or ice allowing it to melt instead of avalanche.

Figure 1A:
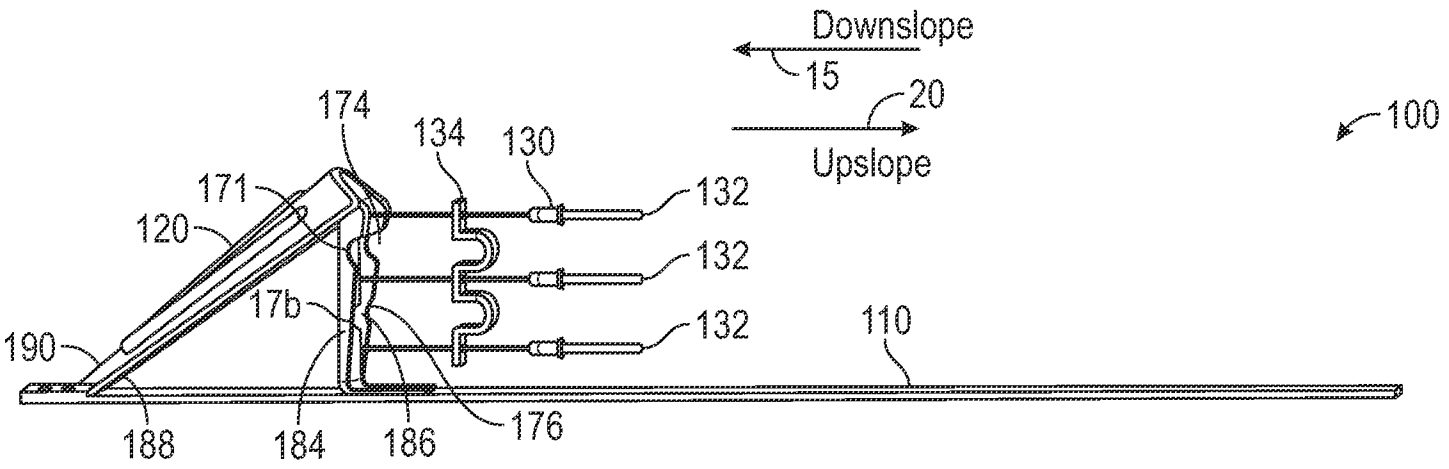
FIG. 1A is a side exploded view of a bracket for a hybrid snow retention system, in accordance with various embodiments.
Figure 1B:
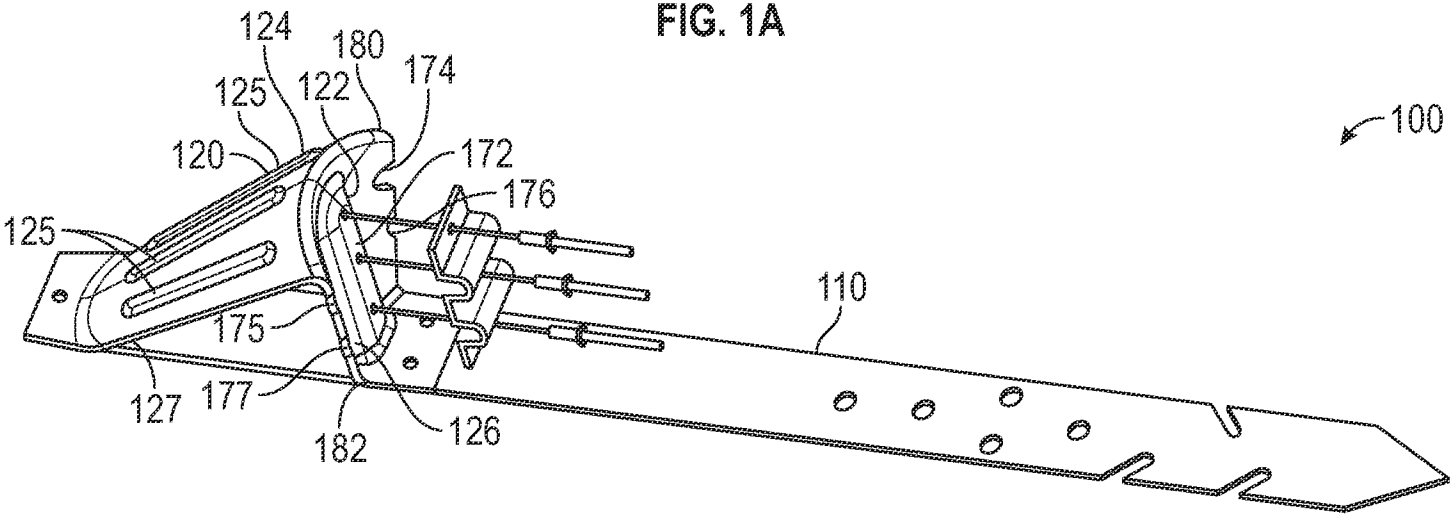
FIG. 1B is a top, upslope, perspective exploded view of a bracket for a hybrid snow retention system, in accordance with various embodiments.
Figure 1C:
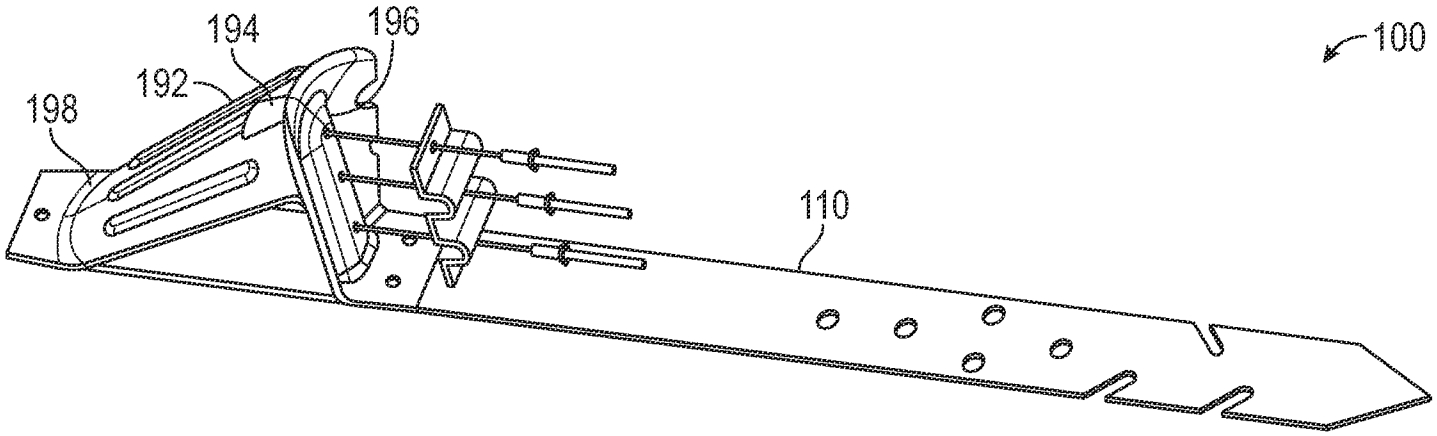
FIG. 1C is a top, upslope, perspective exploded view of a bracket assembly for a hybrid snow retention system, in accordance with various embodiments.

In various embodiments and with reference to FIG. 1A-FIG. 1C, snow guard 100 may comprise a mounting strap 110 and a hybrid pad 120. Snow guard 100 may also comprise a bracket assembly 130 that is installable on hybrid pad 120. Bracket assembly 130 may comprise one or more fasteners 132 (e.g., a screw, a pop rivets, a bolt, and/or any other suitable fastener) and a bracket 134. Bracket assembly 130 may be configured to retain one or more structures to hybrid pad 120.

In various embodiments, mounting strap 110 may have a variable length. In this regard, mounting strap 110 may comprise one or more cut notches. An installer may use a cut notch to adjust the length of mounting strap 110 in the field based on the conditions observed during installation.

In various embodiments, hybrid pad 120 may be monolithic. Hybrid pad may also be an assembly. Hybrid pad may comprise a face portion 122 and a support portion 124. Face portion 122 is generally disposed upslope 20 and faces the upslope direction on a roof or other suitable structure. Support portion 124 is generally disposed downslope 15 and faces the downslope direction on a roof or other suitable structure. Face portion 122 and support portion 124 may be operatively couple to one another.

In various embodiments, support portion 124 may comprise a first side 188 (e.g., a front side) and a second side 190 (e.g., a back side). Support portion 124 may be disposed at an angle (e.g., 25 degrees to 65 degrees) relative to face portion 122. In this regard, support portion 124 may configured to brace and/or support face portion 122 against a load (e.g., a snow load). In this regard, support portion 124 may comprises strengthening structures, i.e., one or more strengthening ribs 125 and/or a curved profile 127. Strengthening ribs 125 may be disposed uniformly about support portion 124. Moreover, support portion 124 may have a curved or partially cylindrical profile 127 for improve strength and load distribution.

In various embodiments, hybrid pad 120 may have a first side 186 (e.g., a front side) and an opposing second side 184 (e.g., a back side). Hybrid pad 120 may also comprise a first edge 180 and a second edge 182. First edge 180 and second edge 182 may generally define the width and/or overall envelope of the face portion 122.

In various embodiments, hybrid pad 120 may comprise a stiffening rib 126. Stiffening rib 126 may be formed in hybrid pad 120. Stiffening rib 126 may also be a separate structure that is installable on hybrid pad 120. Stiffening rib 126 may be defined in or may be installable in face portion 122. Stiffening rib 126 may be located along a center line of face portion 122. In this regard, the face portion 122 of hybrid pad 120 may have a cup shaped or a concave profile. The cup shape of hybrid pad 120 may create a surface that is capable of or configured to catch and retain snow and ice. Stiffening rib 126 may be configured to provide hybrid pad 120 with additional strength. Stiffening rib 126 may also create an engagement surface 172 on the face portion 122 of hybrid pad 120. Surface 172 may define a first load plane or a rib load plane that is parallel to and coplanar with surface 172.

In various embodiments, face portion 122 of hybrid pad 120 may also comprise one or more notches, such as, for example notch 174, notch 176, notch 171, notch 173 and/or the like. Notch 174 and notch 176 may be defined in or located along first edge 180. Notch 171 and notch 173 may be defined in or located along second edge 182. Notch 174 may be coaxially aligned with notch 171. Similarly, notch 176 may be coaxially aligned with notch 173. In this regard, notch 174 and notch 171 may define a second load plane 175. Notch 176 and notch 173 may define a third load plane 177. Second load plane 175 may be coplanar with third load plane 177. Similarly, second load plane 175 and/or third load plane 177 may be coplanar with the first load plane defined by surface 172. Second load plane 175 and/or third load plane 177 may be parallel to the first load plane defined by surface 172. Second load plane 175 and/or third load plane 177 may be offset form the first load plane defined by surface 172.

In various embodiments, stiffening rib 126 and or hybrid pad 120 may comprise one or more weep or drain holes. Hybrid pad 120 may be configured as a heat sink. In this regard, hybrid pad 120 may absorb heat during the day when installed on a roof. The snow and ice retained by hybrid pad 120 may melt in response to the heat being dissipated from hybrid pad 120 into the retain the snow and ice. The water from the melting snow and ice may be configured to drain along the one or more weep holes or drain holes defined in hybrid pad 120 and/or stiffening rib 126. The ability for the water to drain mitigates the risk of ice damning within the cup created by hybrid pad 120.

In various embodiments and with specific reference to FIG. 1C, hybrid pad 120 may be an assembly, as discussed herein. Face portion 196 may be removably installed on support portion 198. Face portion 196 may comprise a strap 192. Strap 192 may be configured to overlap with a portion of support portion 198. Face portion 196 may be mechanically or otherwise operatively coupled to support portion 198 with a fastener or other suitable attachment device. Strap 192 may also have an interlocking structure (e.g., tongue and groove, tooth and channel, and/or the like) that is configured to engage and be retained in support portion 198.

Figure 2A:
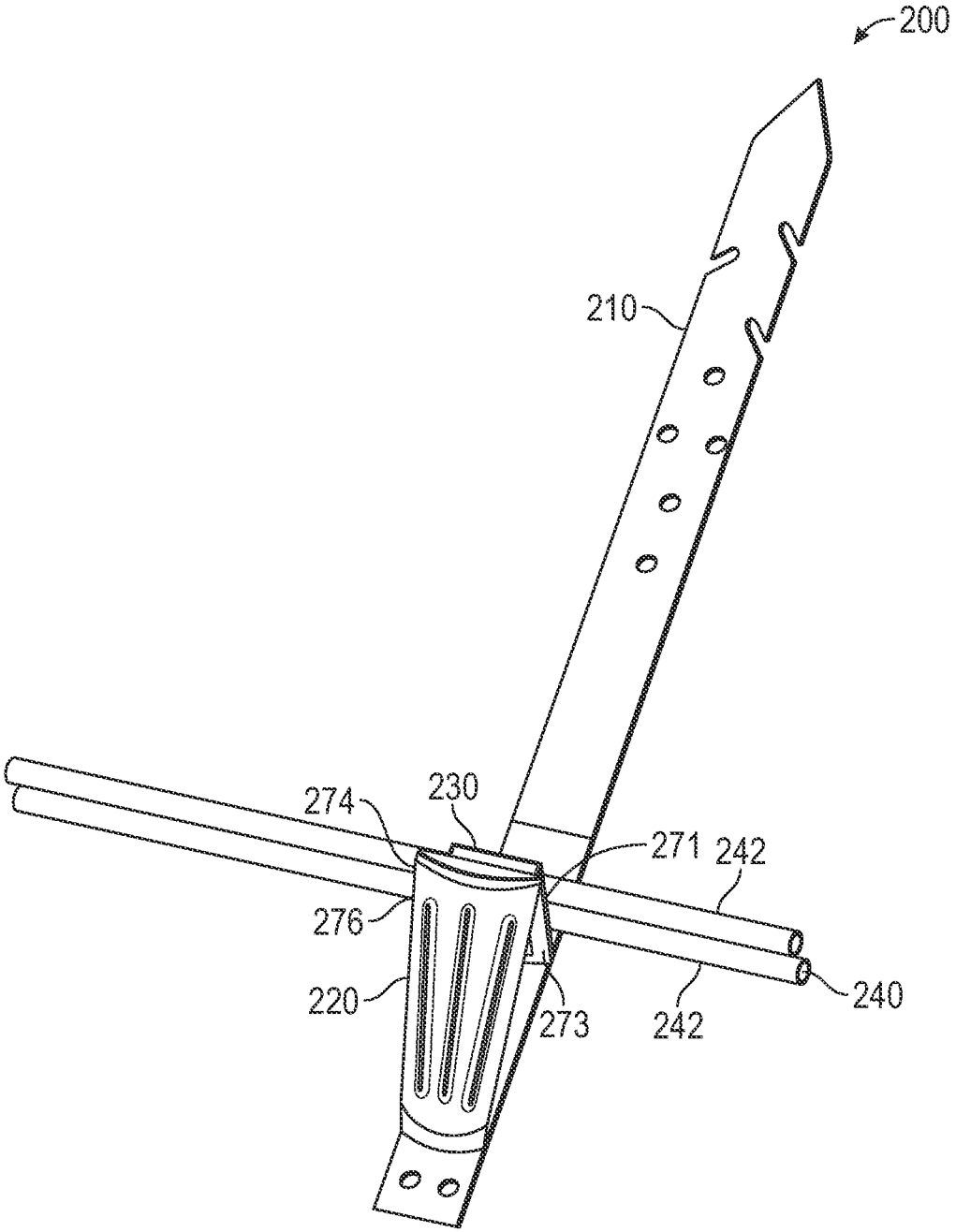
FIG. 2A is a top, down slope, perspective view of a first assembly including rods in a first location for a hybrid snow retention system, in accordance with various embodiments.

In various embodiments and with reference to FIG. 2A, snow guard 200 may comprise the rod assembly 240. Rod assembly 240 may comprise one or more rods 242. Rod 242 may be operatively coupled to hybrid pad 220 with bracket assembly 230. In response to being installed on hybrid pad 220, rod 242 may load against stiffening rib 226 and notch 271, notch 273, notch 274, notch 276, and/or the like. In this regard, snow guard 200 may define a load path between stiffening rib 226 and notch 271, notch 273, notch 274, and notch 276 because the load points are defined in the same plane on the face portion 222 of hybrid pad 220.

In various embodiments and as discussed herein, hybrid pad 220 may act as a heat sink when installed in environment. Specifically, hybrid pad 220 may experience substantial heating when installed at the eve of a roof, allowing hybrid pad 220 absorb heat from the sun. Heat may be distributed from hybrid pad to 220 through rod assembly 240. The distribution of heat through rod assembly 240 may also facilitate melting of retain the snow and ice by snow guard 200.

Figure 2B:
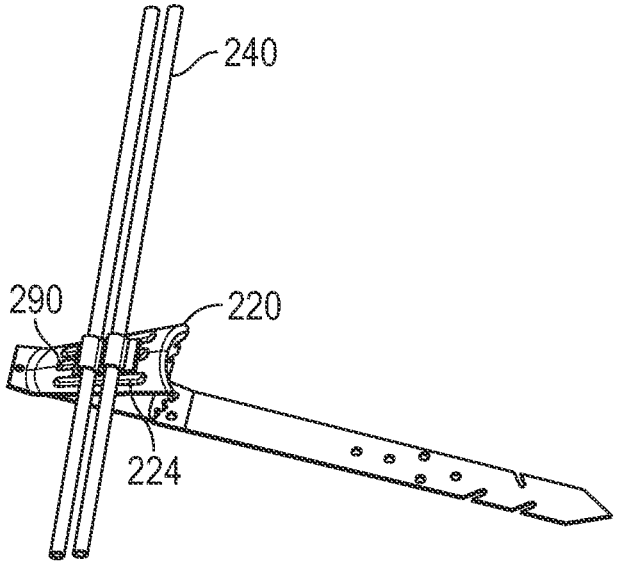
FIG. 2B is a top, down slope, perspective view of a first assembly including rods in a second location for a hybrid snow retention system, in accordance with various embodiments.
Figure 2C:
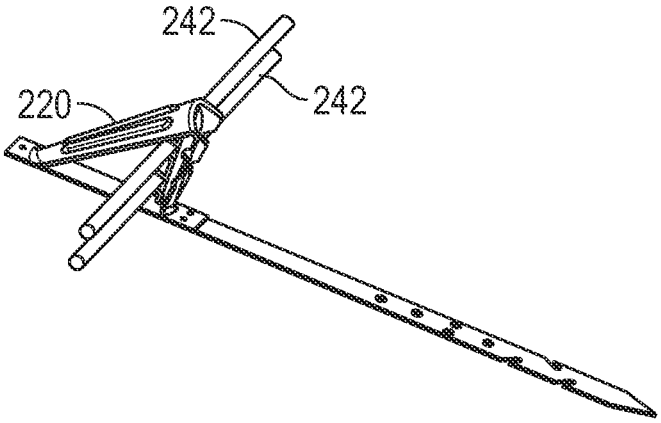
FIG. 2C is a side, perspective view of a first assembly including rods in a third location for a hybrid snow retention system, in accordance with various embodiments.
Figure 2D:
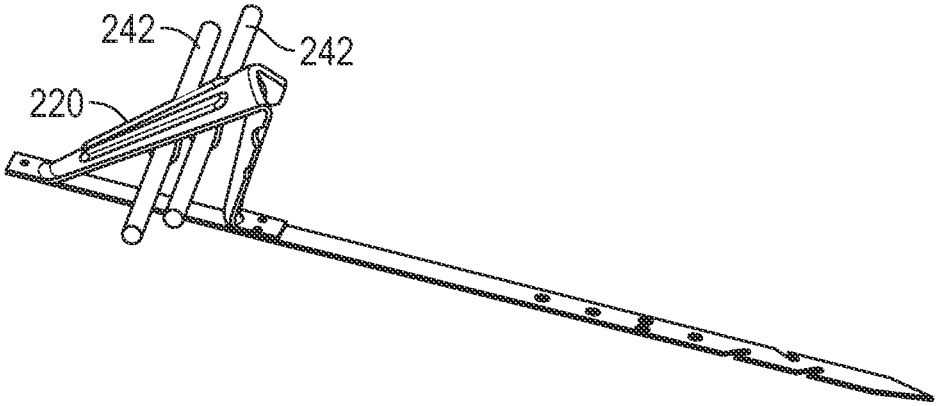
FIG. 2D is a side, perspective view of a first assembly including rods in a fourth location for a hybrid snow retention system, in accordance with various embodiments.
Figure 3A:
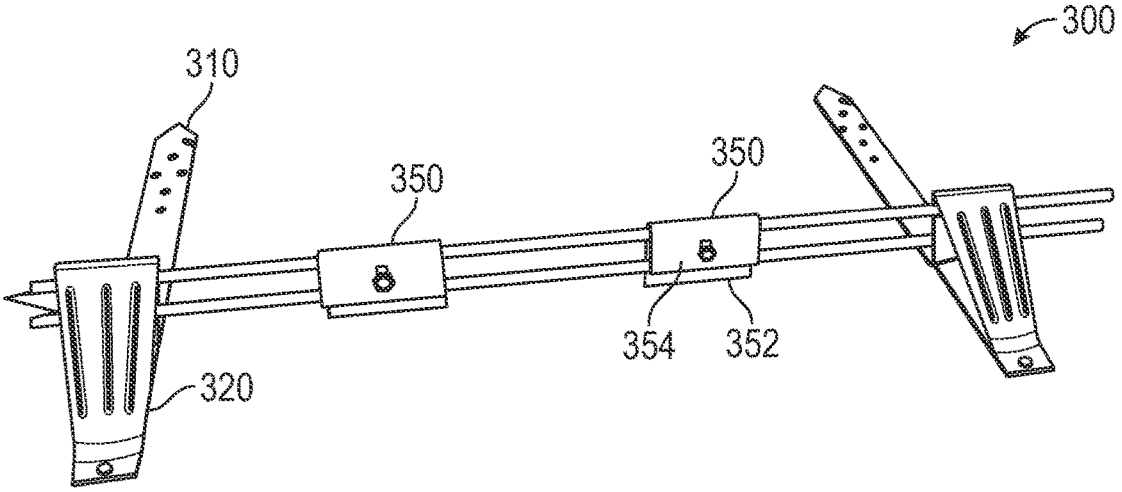
FIG. 3A is a down slope, perspective view of a first assembly including rods and flags in a first location for a hybrid snow retention system, in accordance with various embodiments.
Figure 3B:
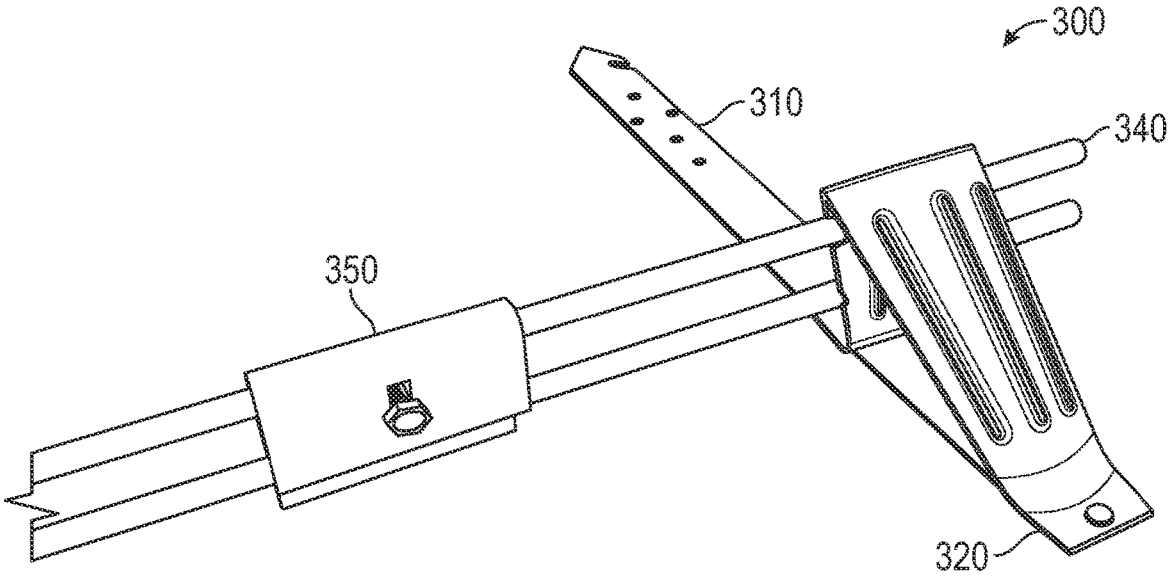
FIG. 3B is a down slope, perspective view of a portion first assembly including rods and a flag in a first location for a hybrid snow retention system, in accordance with various embodiments.
Figure 3C:
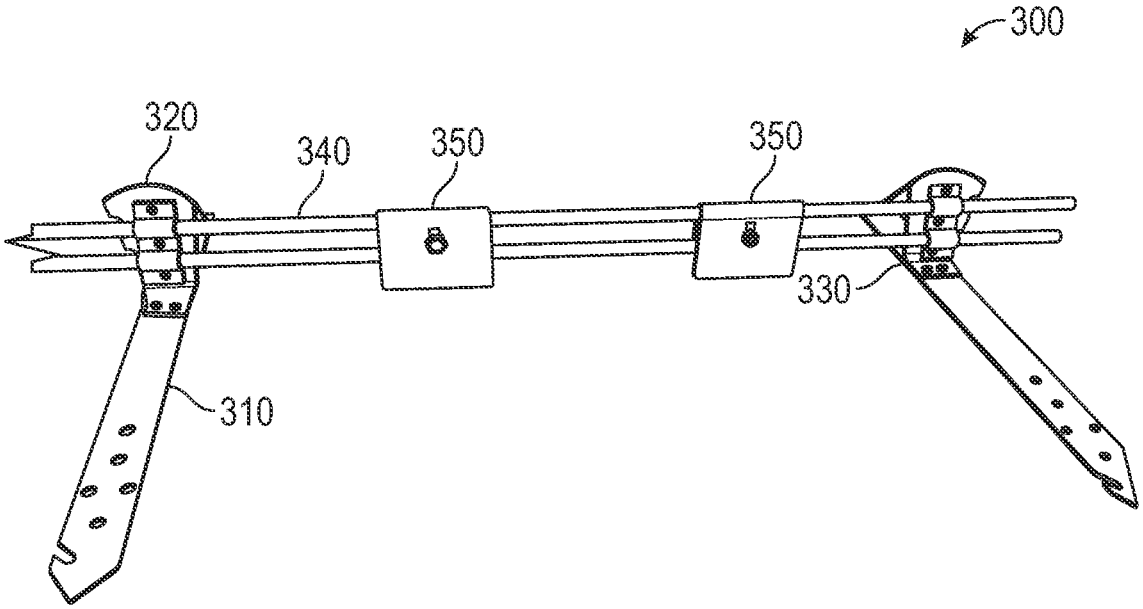
FIG. 3C is an up slope, perspective view of a first assembly including rods and flags in a first location for a hybrid snow retention system, in accordance with various embodiments.
Figure 3D:
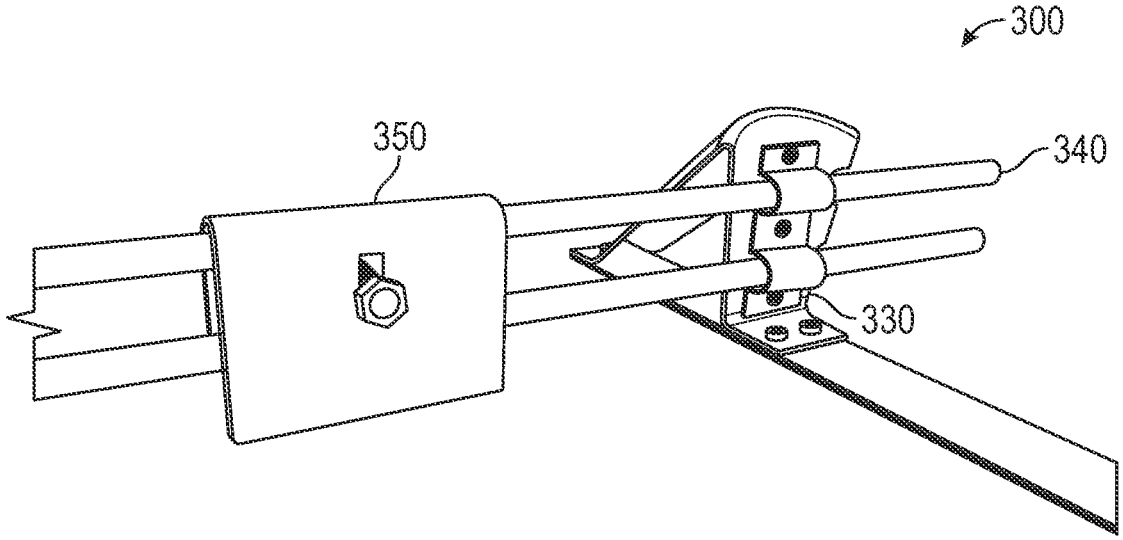
FIG. 3D is an up slope, perspective view of a portion first assembly including rods and a flag in a first location for a hybrid snow retention system, in accordance with various embodiments.

In various embodiments and with reference to FIGS. 2B-2D, rod assembly 240 may be installed on hybrid pad 220 at any suitable location. For example, rod assembly 240 may be installed on back surface 290 of support member 224, as shown in FIG. 2B. Rod assembly 240 may also be installed on an interior surface of hybrid pad 220 as shown in FIG. 2C or 2D.

In various embodiments and with reference to FIGS. 3A-3D, snow guard 300 may comprise one or more ice flags 350. Ice flag 350 may be installed on rod assembly 340 at any suitable location to retain ice and snow. Ice flag 350 may be retained on rod assembly 340 with a fastener assembly such as, for example a nut and bolt.

Figure 4A:
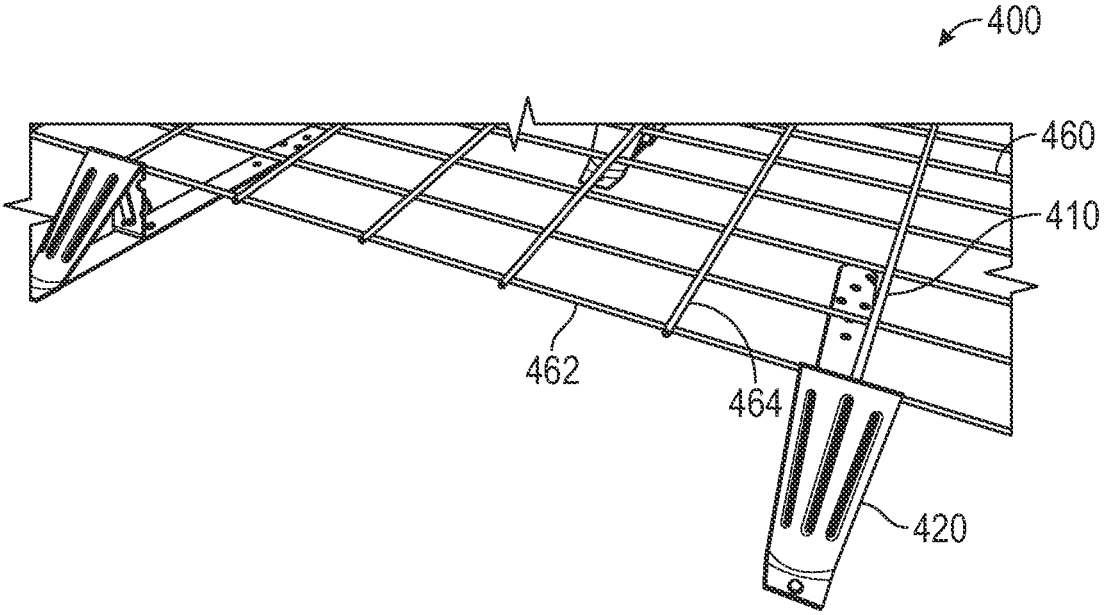
FIG. 4A is a first down slope, perspective view of a first assembly including an ice screen for a hybrid snow retention system, in accordance with various embodiments.
Figure 4B:
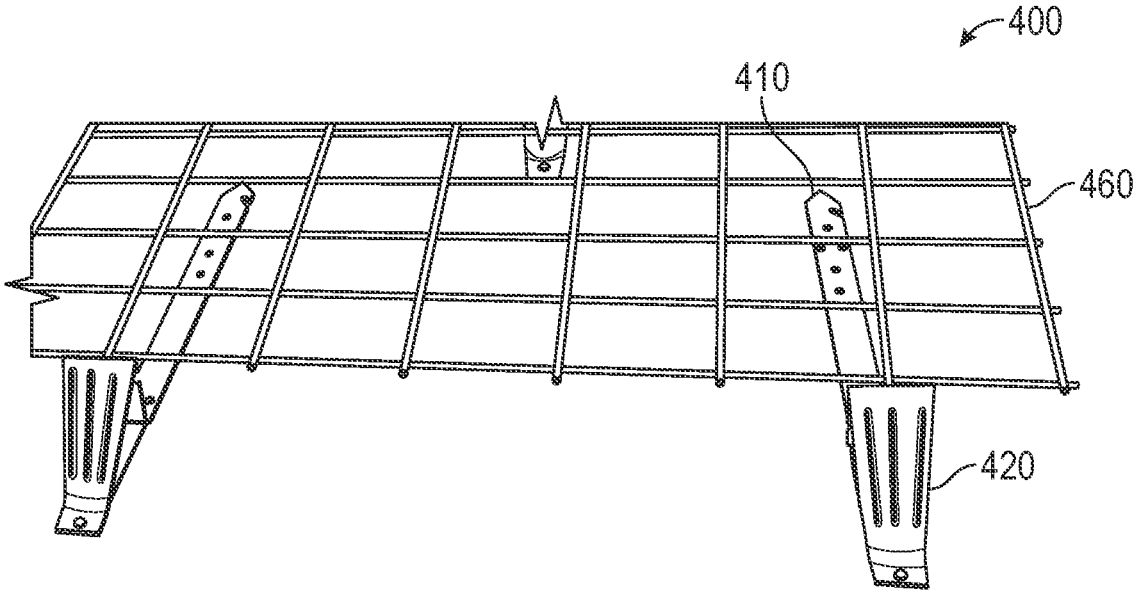
FIG. 4B is a second down slope, perspective view of a first assembly including an ice screen for a hybrid snow retention system, in accordance with various embodiments.

In various embodiments and with reference to FIGS. 4A and 4B, snow guard 400 may comprise an ice screen 460. Ice screen 460 may be an expanded metal screen that is configured to mount to hybrid pad 420. Ice screen 460 may have a screen density. The screen density may be defined by the thickness and spacing of lateral rods 462 and longitudinal rods 464. For example, screen density may be defined where lateral rods 462 and longitudinal rods 464 are spaced in a 1-inch×1-inch, 2-inch×2-inch, 1-inch×2-inch, 3-inch×3-inch, 2-inch×4-inch configurations as shown in FIG. 4A, and/or any other suitable configuration or spacing. Ice screen 460 may also be configured to conduct heat from hybrid pad 420.

Figure 5A:
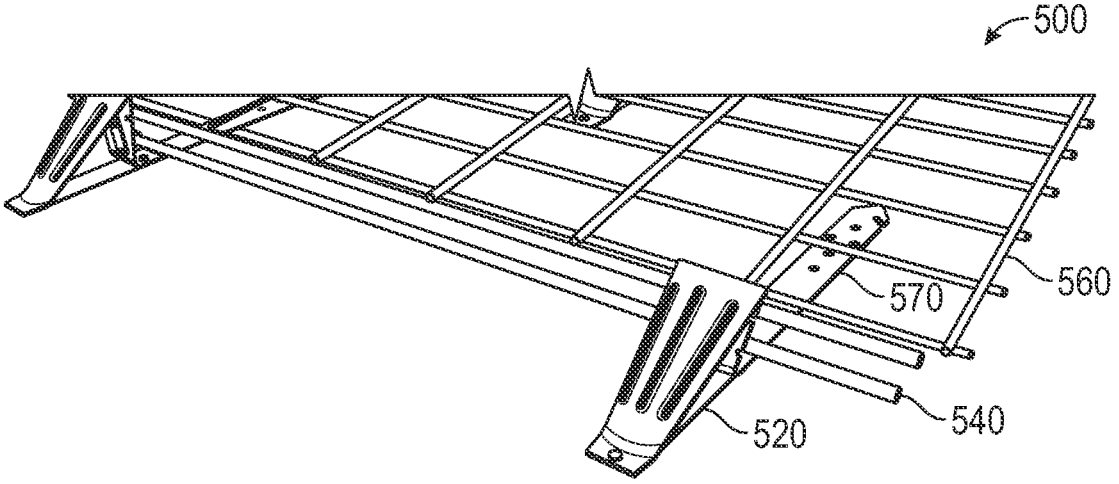
FIG. 5A is a down slope, perspective view of a first assembly including rods and an ice screen in a first location for a hybrid snow retention system, in accordance with various embodiments.
Figure 5B:
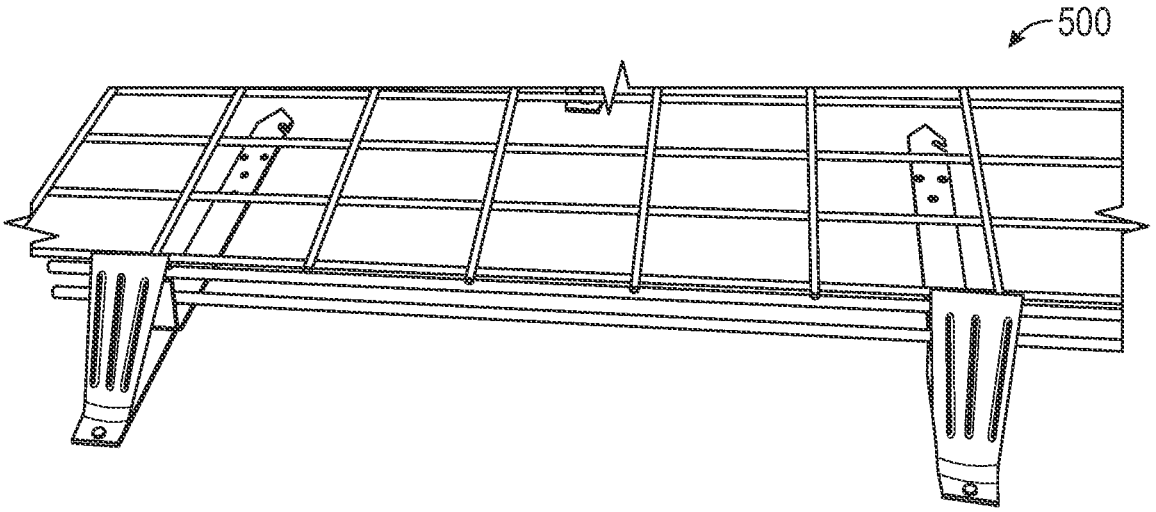
FIG. 5B is a down slope, back view of a first assembly including rods and an ice screen in a first location for a hybrid snow retention system, in accordance with various embodiments.
Figure 6A:
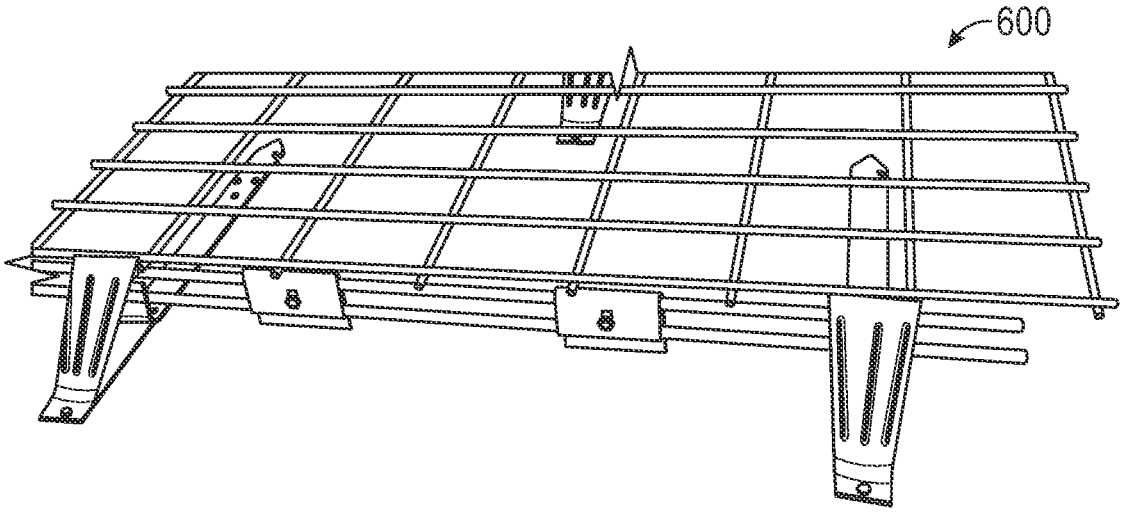
FIG. 6A is a first down slope, perspective view of a first assembly including rods, flags, and an ice screen in a first location for a hybrid snow retention system, in accordance with various embodiments.
Figure 6B:
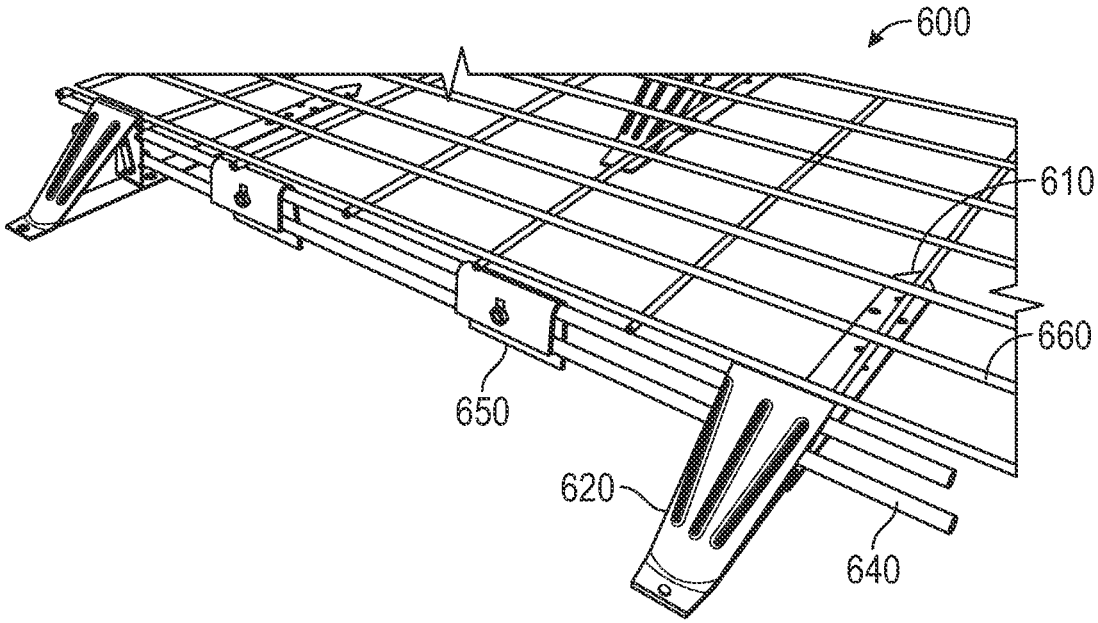
FIG. 6B is a second down slope, perspective view of a first assembly including rods, flags, and an ice screen in a first location for a hybrid snow retention system, in accordance with various embodiments.
Figure 7A:
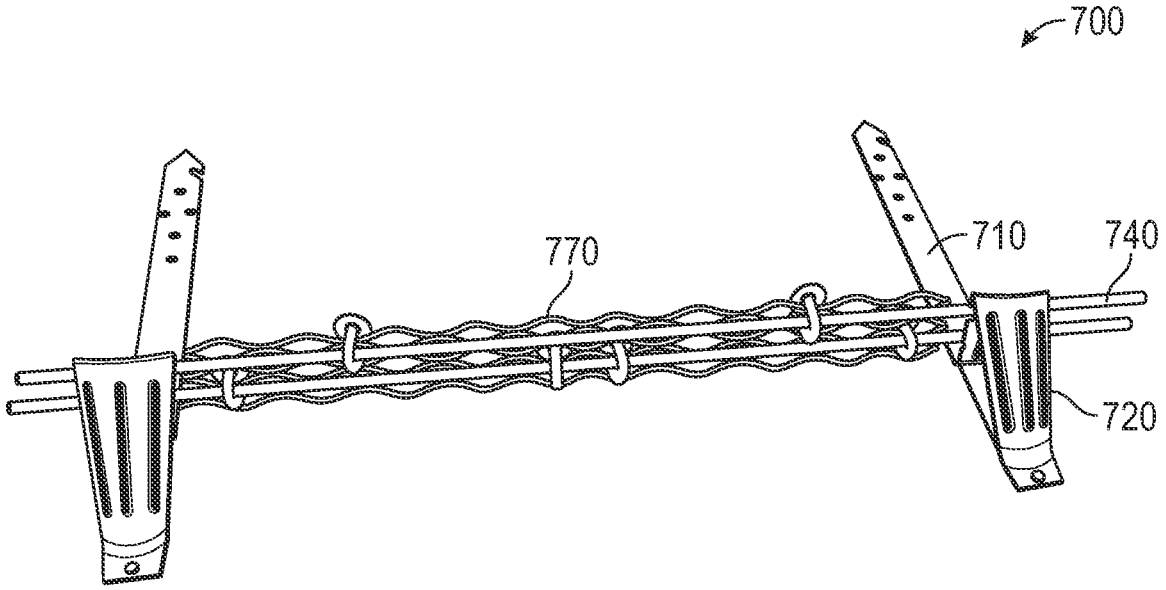
FIG. 7A is a first down slope, perspective view of a first assembly including rods, and an expanded metal screen in a first location for a hybrid snow retention system, in accordance with various embodiments.
Figure 7B:
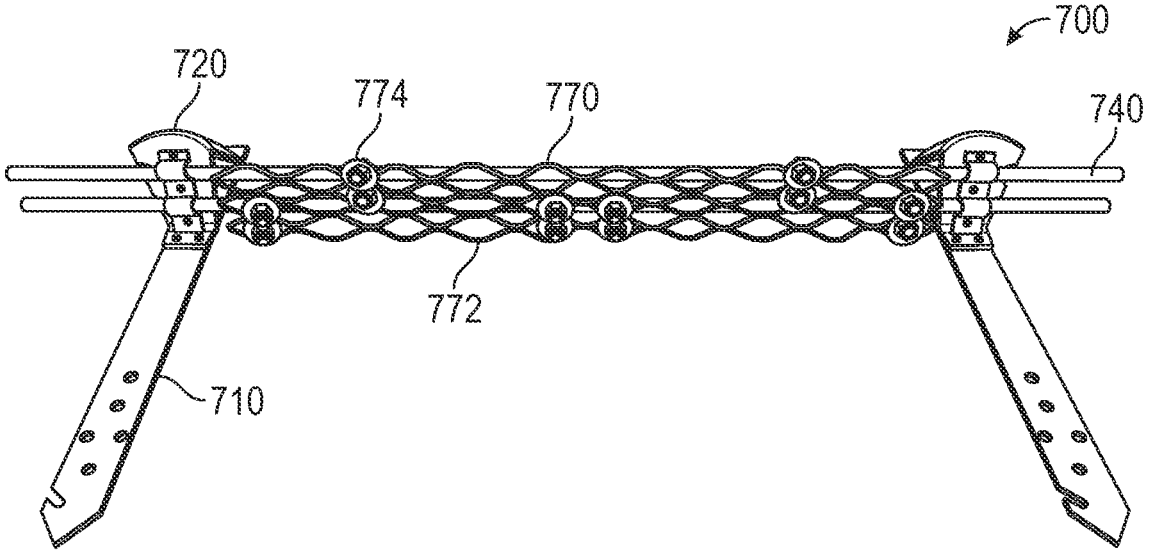
FIG. 7B is a first up slope, perspective view of a first assembly including rods, and an expanded metal screen in a first location for a hybrid snow retention system, in accordance with various embodiments.
Figure 7C:
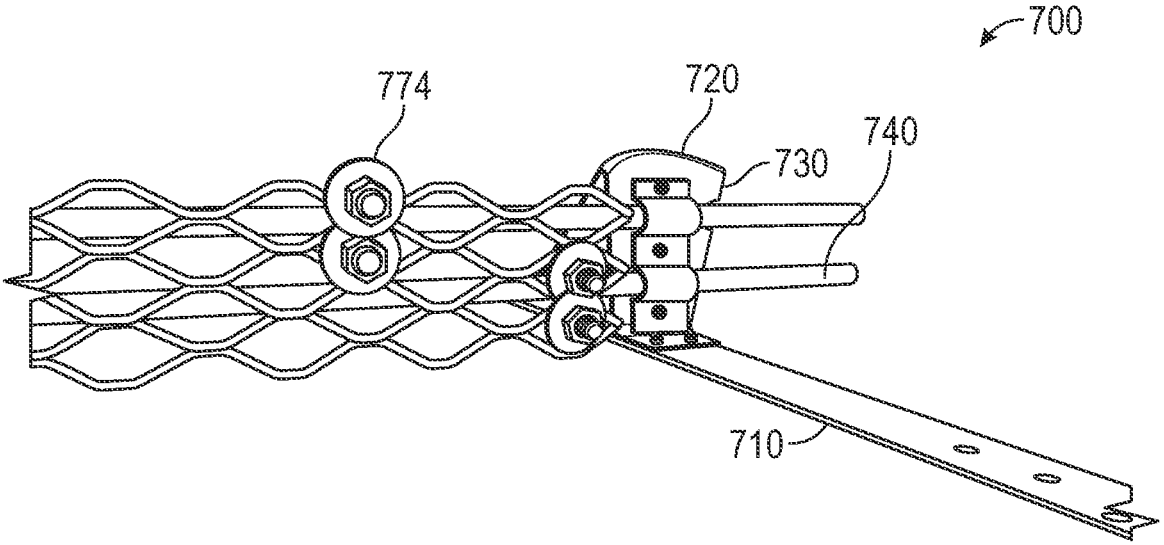
FIG. 7C is a second up slope, perspective view of a portion of a first assembly including rods, and an expanded metal screen in a first location for a hybrid snow retention system, in accordance with various embodiments.
Figure 7D:
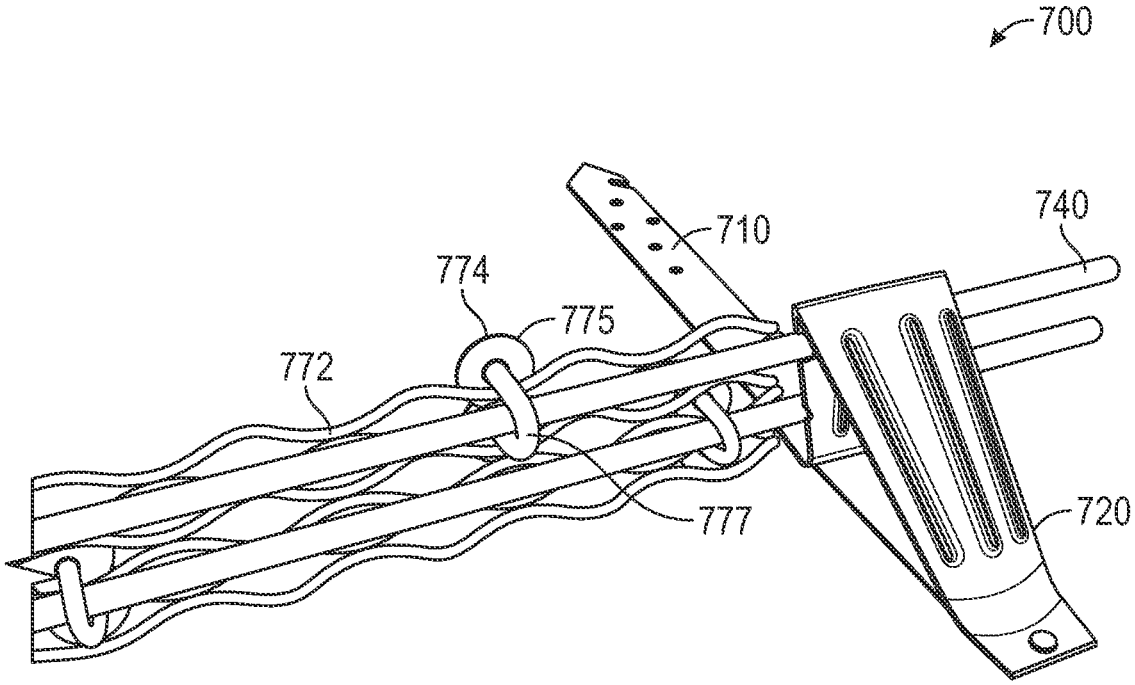
FIG. 7D is a second down slope, perspective view of a portion of a first assembly including rods, and an expanded metal screen in a first location for a hybrid snow retention system, in accordance with various embodiments.
Figure 8A:
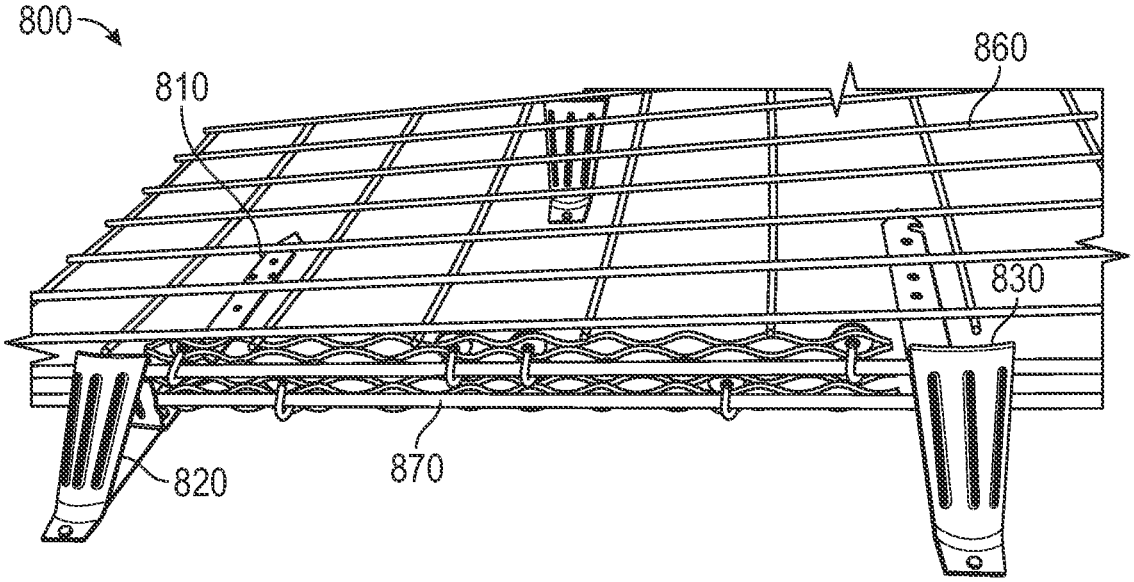
FIG. 8A is a first down slope, perspective view of a first assembly including rods, an expanded metal mesh, and an ice screen in a first location for a hybrid snow retention system, in accordance with various embodiments.
Figure 8B:
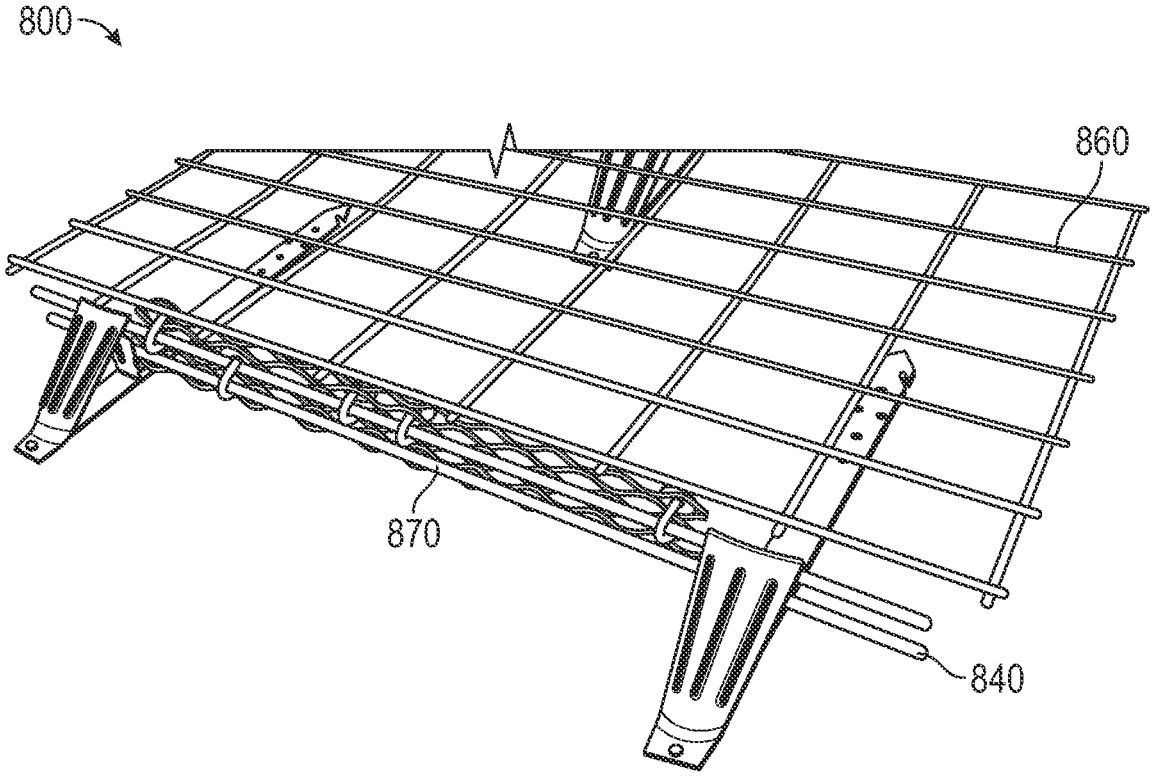
FIG. 8B is a second down slope, perspective view of a first assembly including rods, an expanded metal mesh, and an ice screen in a first location for a hybrid snow retention system, in accordance with various embodiments.

In various embodiments and with reference to FIGS. 5A-5B, snow guard 500 may include a hybrid snow and ice retention structure. For example, snow guard 500 may comprise a rod assembly 540 and an ice screen 560. In other embodiments and with reference to FIGS. 6A-6B, snow guard 600 may comprise a rod assembly 640, ice flags 650 and ice screen 660. Each of these hybrid snow and ice retention structures may be configured to distribute heat from the hybrid pad. In other embodiments and with reference to FIGS. 7A-7D, Snowbird 700 may comprise a wire mesh assembly 770. Wire mesh assembly 770 may be operatively coupled to and/or supported by rod assembly 740. Wire mesh assembly 770 may attach to rod assembly 740 with an attachment assembly 774. Wire mesh assembly 770 may be configured as a debris and/or ice catching structure. Moreover, wire mesh assembly 770 may be an expanded wire mesh having a finer wire mesh density than other systems described herein. In other embodiments and with reference to FIGS. 8A-8B, snow guard 800 may comprise a wire mesh assembly 870 operatively coupled to a rod assembly 840 and an ice screen 860.

Figure 9A:
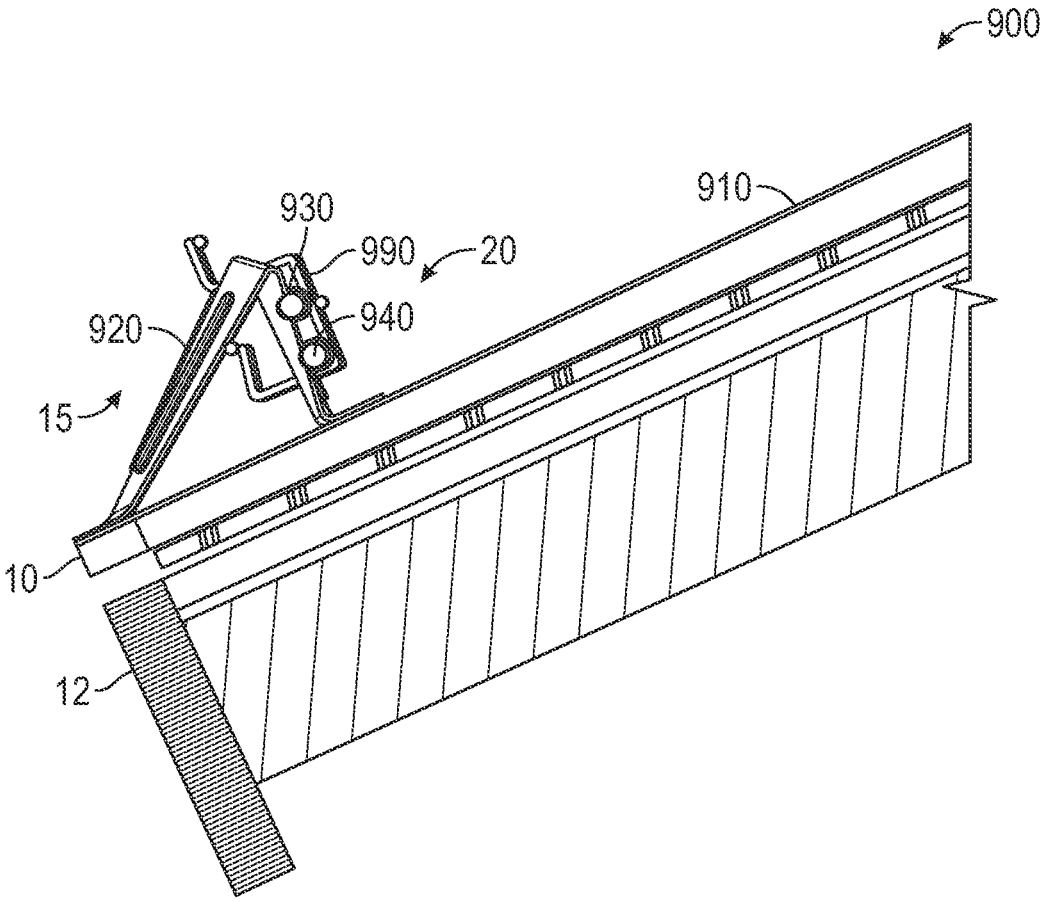
FIG. 9A is a side view of a hybrid snow retention system including rods and a tray attached to a structure surface (e.g., a building facade, roof, and/or the like), in accordance with various embodiments.
Figure 9B:
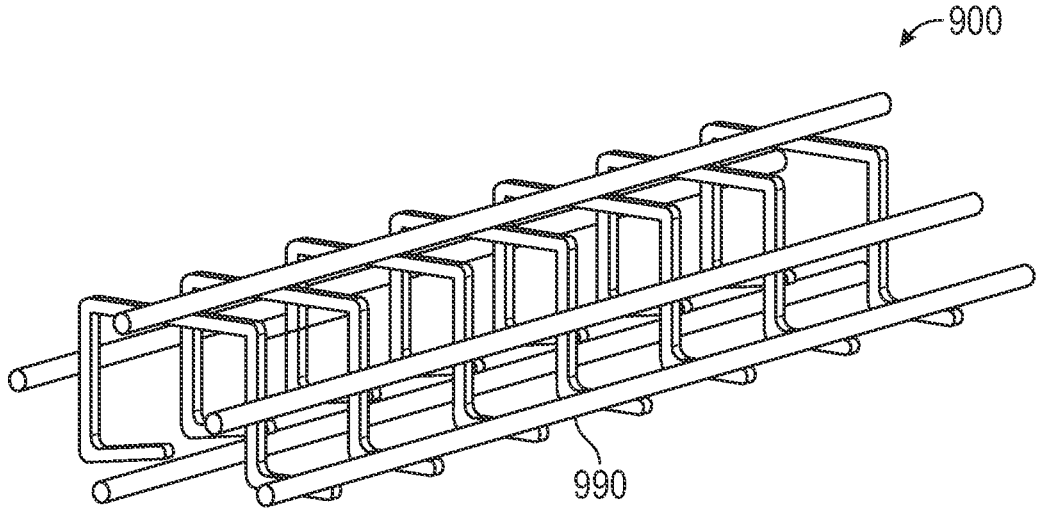
FIG. 9B is a of a tray for use with a hybrid snow retention system, in accordance with various embodiments.

In various embodiments and with reference to FIG. 9A-9B, snow guard 900 may be deployable on a roof 10 of the house or building 12. Snow guard 900 may comprise a snow and ice mesh 990 that is installable on rod assembly 940 and/or hybrid pad 920. Snow and ice mesh 990 may be installable on rod assembly 940 with bracket assembly 930. Moreover, snow and ice mesh 990 may be configured to provide a higher snow and ice retention factor by providing increased surface area and friction points for rod assembly 940.

Figure 10A:
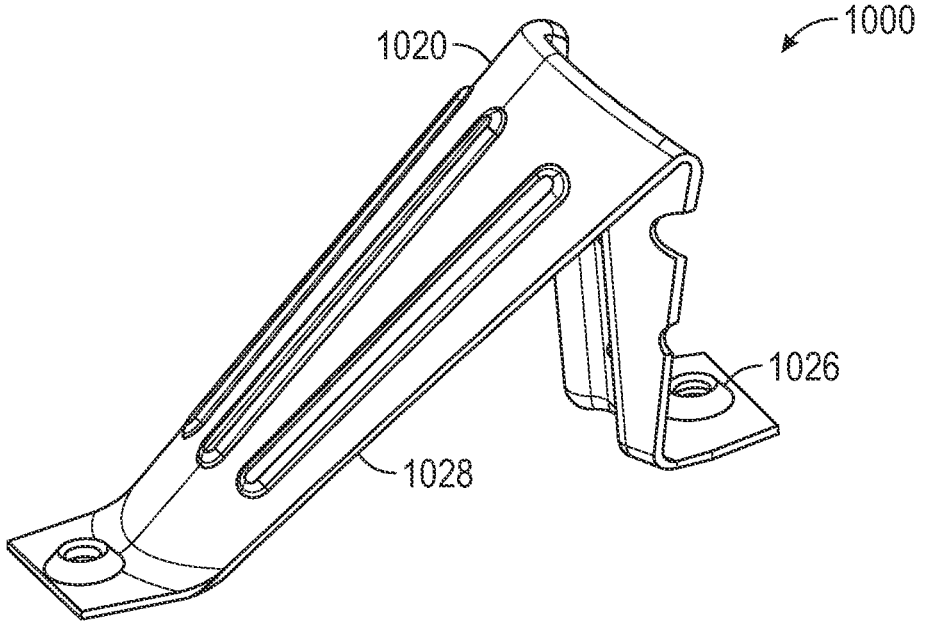
FIG. 10A is a of a bracket body for use with a hybrid snow retention system, in accordance with various embodiments.
Figure 10B:
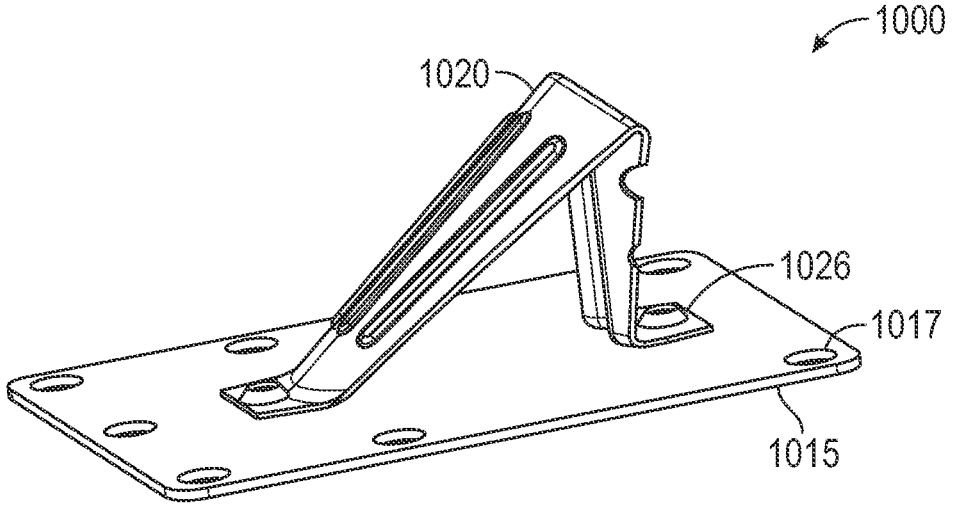
FIG. 10B is a of a bracket body and mounting plate for use with a hybrid snow retention system, in accordance with various embodiments.
Figure 10C:
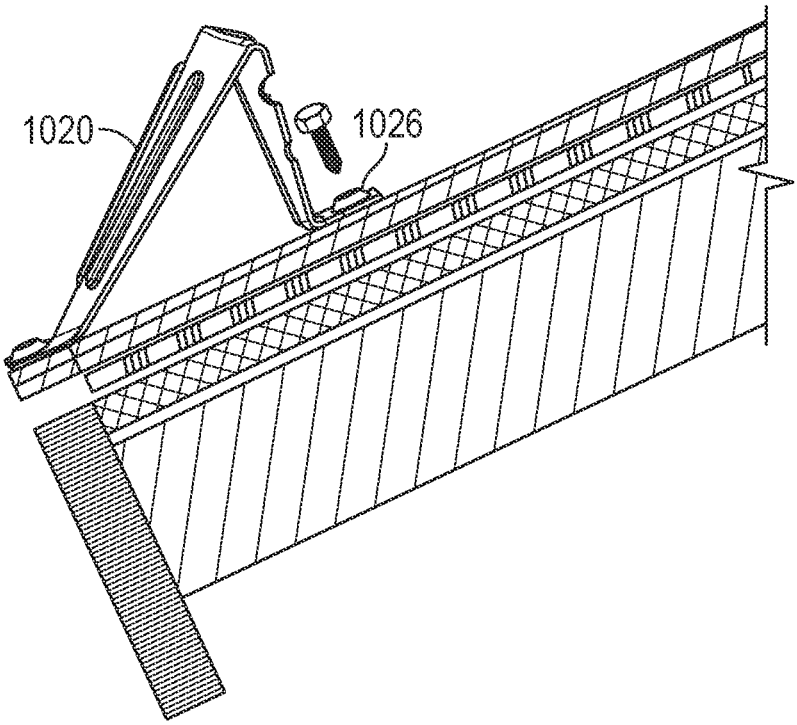
FIG. 10C is a of a bracket body for use with a hybrid snow retention system mounted to a structure surface, in accordance with various embodiments.

In various embodiments and with reference to FIG. 10A-10C, snow guard 1000 may be a hybrid pad 1020. Hybrid pad 1020 may comprise a body 1028 and one or more attachment points. For example, hybrid pad 1020 may comprise one or more dimples 1026. Dimples 1026 may define a cavity that is capable of being filled with the sealant to create a watertight connection with the roof surface. Moreover, dimple 1026 may be configured to accept a fastener so that hybrid pad 1020 may be mounted on the roof surface.

In various embodiments, snow guard 1000 may also comprise a mounting plate 1015. Hybrid pad 1020 may be installable on and/or operatively coupled to mounting plate 1015. Mounting plate 1015 may comprise one or more mounting holes 1017. Moreover, mounting plate 1015 may be sized to facilitate direct to deck mounting of hybrid pad 1020.

In various embodiments, any of the systems described herein may be combined with a resistive heating structure or wire to facilitate the safe shedding a snow and ice from building roofs and surfaces.

One of skill in the art will appreciate after reading the present disclosure and accompanying figures that each of the embodiments described herein may be adapted to work with elements of other embodiments of the present disclosure.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A bracket, comprising: a mounting strap; a hybrid pad comprising a face portion and a support portion, the face portion and the support portion being operatively coupled together, the hybrid pad operatively coupled to the mounting strap, the face portion, comprising, a stiffening rib defined in a front surface of the face portion, the stiffening rib defining a first load plane, and the face portion defining a first rod notch on a first side of the face portion and a second rod notch on a second side of the face portion, the stiffening rib being defined between the first side and the second side, the first rod notch and the second rod notch defining a second load plane; a bracket assembly comprising a bracket and a fastener, the bracket assembly operatively coupled to the hybrid pad; at least one rod mountable to the hybrid pad and configured to contact the face portion at the stiffening rib in the first load plane and the first rod notch and the second rod notch in the second load plane, wherein the rod is secured to the hybrid pad with the bracket assembly.

2. The bracket of claim 1, wherein the second load plane is coplanar with the first load plane.

3. The bracket of claim 1, wherein the hybrid pad is monolithic.

4. The bracket of claim 1, wherein the hybrid pad is an assembly.

5. The bracket of claim 1, wherein the mounting strap has a variable length.

6. The bracket of claim 1, wherein the mounting strap includes a plurality of cut notches.

7. The bracket of claim 1, further comprising an ice screen having a variable screen density, the ice screen being operatively coupled to the rod.

8. The bracket of claim 1, wherein the at least one rod comprises a plurality of rods.

9. The bracket of claim 8, wherein each of the rods of the plurality of rods engages the hybrid pad in a plane that is coplanar with the first load plane and the second load plane.

10. A snow guard attachment bracket, comprising:

a mounting strap;

a hybrid pad comprising a face portion and a support portion, the face portion and the support portion being operatively coupled together, the hybrid pad operatively coupled to the mounting strap, the hybrid pad comprising a plurality of mounting points, the face portion, comprising, a stiffening rib defined in a front surface of the face portion, a plurality of mounting holes defined through a stiffening to define a first mounting point of the plurality of mounting points on a first face side of the face portion, the plurality of mounting holes defining a second mounting point on a second face side of the face portion, and the support portion, comprising a third mounting point of the plurality of mounting points on a first support side of the support portion and a fourth mounting point of the plurality of mounting points on a second support side of the support portion;

a rod mountable to one of the plurality of mounting points; and a bracket configured to engage one of the plurality of mounting points and retain the rod on the hybrid pad.

11. The snow guard attachment bracket of claim 10, further comprising an ice screen having a variable screen density operatively coupled to at least one of the rod and the hybrid pad.

12. The snow guard attachment bracket of claim 10, further comprising a second rod.

13. The snow guard attachment bracket of claim 10, wherein the stiffening rib defines a first load plane, the face portion defining a first rod notch on a first edge of the first face side and a second rod notch on a second edge of the first face side, the stiffening rib being defined between the first edge and the second edge, the first rod notch and the second rod notch defining a second load plane.

14. The snow guard attachment bracket of claim 13, wherein the first load plane and the second load plane are coplanar.

15. The snow guard attachment bracket of claim 14, wherein the rod is configured to engage and be supported by the stiffening rib, the first rod notch, and the second rod notch.

16. The snow guard attachment bracket of claim 14, wherein the rod is installable in the first load plane and the second load plane.

17. The snow guard attachment bracket of claim 13, wherein the rod is installable in at least on the first load plane and the second load plane.

18. A snow guard, comprising:

a hybrid pad comprising a face portion and a support portion, the face portion and the support portion being operatively coupled together, the face portion, comprising, a stiffening rib defined in the face portion, a plurality of mounting holes defined through the stiffening rib to define a first mounting point;

the face portion comprising a first notch along a first edge of the face portion and a second notch along a second edge of the face portion, the first notch and the second notch define a notch plane;

a rod mountable to the face portion in the first notch and the second notch, wherein the rod is supported by the hybrid pad in the notch plane; and a bracket configured to engage the face portion and retain the rod on the hybrid pad.

19. The snow guard of claim 18, wherein the stiffening rib defines a rib plane that is coplanar with the notch plane.

20. The snow guard of claim 19, wherein the rod is configured to engage and be supported by the rib plane in response to being installed on the hybrid pad.

* * * * *